United States Patent [19]

Opal

[11] 3,942,507

[45] Mar. 9, 1976

[54] PROCESS OF SIGHTING AN ARCHERY BOW

[76] Inventor: Edward Opal, 2 Greenlawn Ave., Bainbridge, N.Y. 13733

[22] Filed: Apr. 15, 1974

[21] Appl. No.: 461,246

[52] U.S. Cl. ..... 124/30 A; 33/265; 124/35 A

[51] Int. Cl.[2] ..... F41B 5/00

[58] Field of Search .... 124/30 A, 30 R, 24 R, 23 R, 124/35 A, 35 R, 41; 33/265

[56] References Cited

UNITED STATES PATENTS 3,199,502 8/1965 Stonecipher ..... 124/30 A 3,749,076 7/1973 Suski et al. ..... 124/35 A

*Primary Examiner*—Richard C. Pinkham

*Assistant Examiner*—William R. Browne

[57] ABSTRACT

A process is provided for sighting an arrow through the separated strands of a bow string. The process includes the manual adjustment of two circular disks, that have been positioned in the string so as to hold the strands separated from each other, along the axis of the string so as to provide adjustable sighting for different users.

1 Claim, 7 Drawing Figures

PROCESS OF SIGHTING AN ARCHERY BOW

BACKGROUND OF THE INVENTION

The present invention relates to improvements in archery equipment and in particular to apparatus for improving the sighting of an arrow and in the release of the arrow from the bow.

As is well known the arrow is sighted by the archer as he draws the string backwards towards his body and rests his trigger hand adjacent his face. In this condition the string tends to fall directly in line with the archer's eye and it is necessary for him to cant or tilt his head in order to sight past the string. Thus the archer's sight line is offset and angular to the axis of the arrow. As a result great skill must be developed by the archer, to compensate for this misalignment, in addition to the skill necessary to compensate for wind, distance, etc. Several attempts have been made to provide sighting apparatus, in general such attempts have provided complex aiming devices which must be fastened to the limb or bow itself.

A second troublesome situation common to most archers lies in the difficulties encountered in drawing the arrow and string and in subsequently releasing the arrow. Under the extremely high pull stress, the archer's fingers are frequently cut and wounded. Moreover, few but the very experienced archers, have fingers strong enough to grasp and hold both the arrow and the string sufficiently long to obtain a good steady sight. Lastly, few archers are capable of releasing the string quickly and smoothly enough to prevent the string from skewing and moving off target. Here attempts have been made to provide the archer with special gloves or finger cots, however, these are not completely satisfactory. It is the object of the present invention to provide a process for sighting an arrow through the strands of a bow string by manually moving disks in the strand to varying positions to accommodate different users.

SUMMARY OF THE INVENTION

According to the present invention an archery bow is provided in which the string is formed of a plurality of separate strands. Nub means are inserted between the strands to space them apart at least along the axis of the archer's eye. The nub is located within the strands and is provided with uniformly spaced axial grooves on its peripheral surface, each retaining one of the strands of the string. Preferably two nubs are used, spaced apart from each other so that the strands are spaced in a cylindrical fashion along a portion of the string.

The present invention has the advantage in that the normal string construction, either twisted strands, or braided strands, can be maintained essentially intact; that only a portion of the length of the string need be separated; that the nub is retained solely within the strands of the string and will not extend outward to interfere with the position of the head or eye, and will not create a hazard once the arrow is released. Above all the present invention separates the strands sufficiently so that they present very little interference with the ability of the archer to see, and provide a sight aperture for the archer directly through the string.

According to the present invention a quick release mechanism is provided comprising a body shaped as a hand grip having means for engaging the nock end of the arrow and releasibly holding it. The mechanism is provided with a trigger release, capable of easy manipulation by a single finger, which results in a swift and clean release of the arrow.

The mechanism is preferably provided with a pistol grip body, having a hole for receiving the nock end of the arrow, and latch means, engaging the nock and holding it under resilient conditions sufficient to permit the string to be pulled taut. The latch is openable by a trigger mechanism actuated by the thumb of the archer, leaving his other fingers free to maintain a strong steady grip on the body. It may be necessary in adapting arrows for use with present release mechanisms, that their nock be modified from the conventional structure. Preferably the nock should be long enough to fit in the hole of the release mechanism and be provided with a long groove and a suitably shaped notch in which the string may be received and the bar of the latch may be secured.

The advantage of the present invention is apparent in that a grip is provided which enables strong and secure holding of the arrow and string simultaneously; enables the archer to employ his total strength in holding the grip and not be annoyed or inhibited by the string or arrow; and furthermore not loose aim or spoil the position of the bow or arrow when releasing the arrow.

Full details of the present invention are set forth in the following description and in the accompanying drawings.

DESCRIPTION OF THE INVENTION

Figure 1:
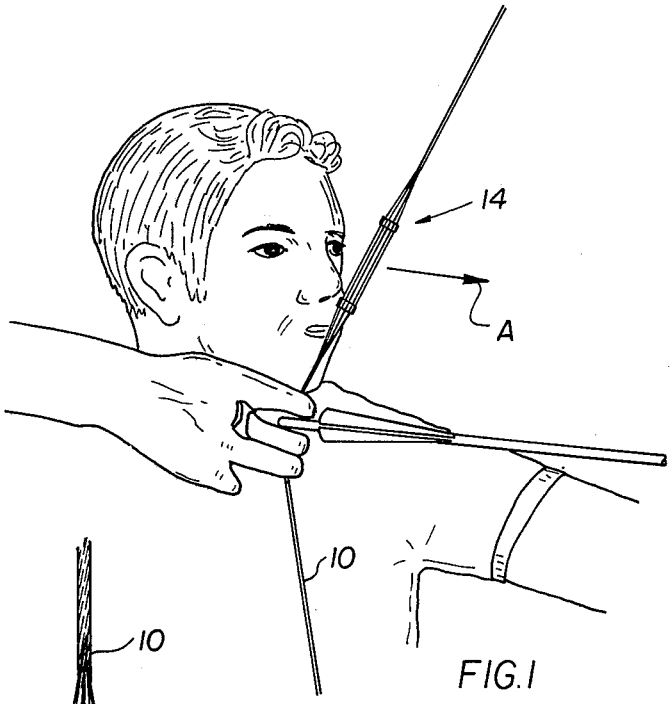
FIG. 1 is a partial view of the bow illustrating the position of an arrow and the string incorporating the present invention during aiming.
Figure 2:
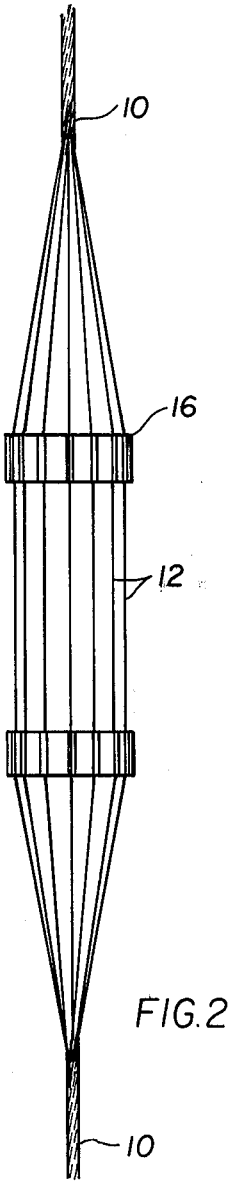
FIG. 2 is an enlarged view of the string of FIG. 1 showing the details of the present invention.
Figure 3:
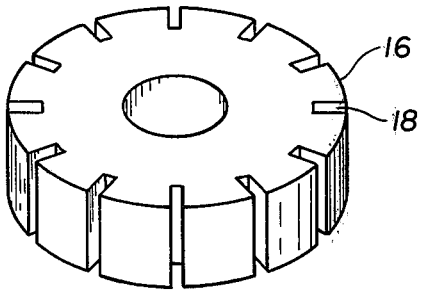
FIG. 3 is an enlarged perspective view of the nub.
Figure 5:
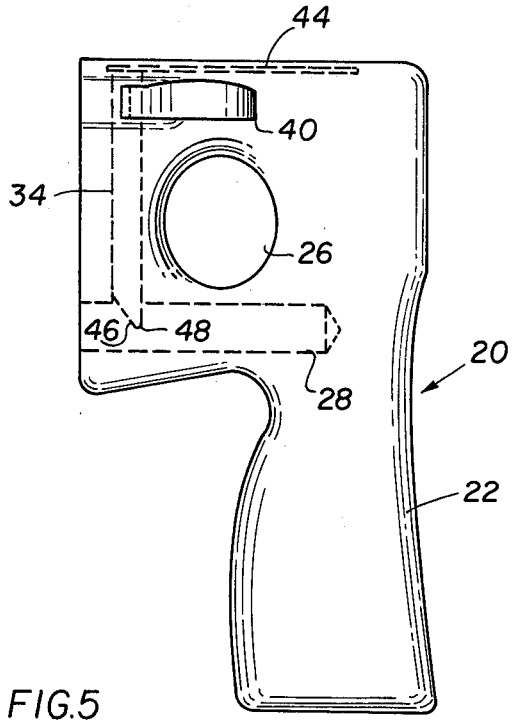
FIG. 5 is side elevation view partial in section of the release mechanism.
Figure 6:
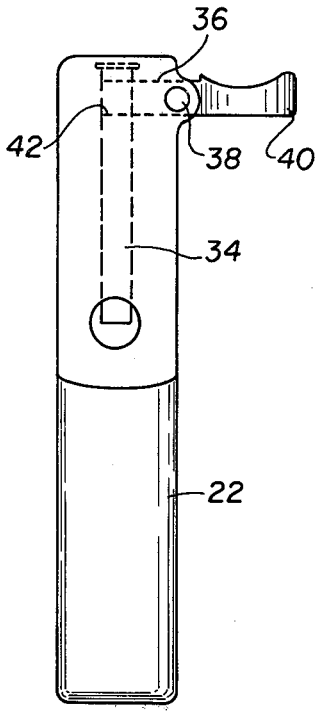
FIG. 6 is an end elevation partial in section of the release mechanism.

The see-through string of the present invention is incorporated in an otherwise conventional bow, the construction of which may follow anyone of the well known techniques therefor. Accordingly, only that portion of the bow necessary for an understanding of the present invention is shown in FIGS. 1–3, the remainder and the bow such as the limb being omitted, for brevity and clarity.

The bow's string 10 is formed from a plurality of separate strands 12 of conventional material, braided or twisted in the usual manner. The string 10 is provided with an aperture, generally depicted by the numeral 14, through which the archer can sight, as indicated by arrow A. The aperture 14 is formed by separating the individual strands 12 and by inserting between the strands, spaced from each other, a pair of nubs 16 of about ⅜–½ inch diameter. The nubs 16 are in the embodiment shown flat washer-like or circular disks, having a plurality of radial grooves 18 distributed uniformly about its circumference. In general the number of slots 18 should conform to the number of strands 12 in the string 10, and the radial depth of the groove 18 only slightly larger than the diameter of the strand.

The position of either of both of nubs 16 along the string and the distance between them can be varied so that the position of the aperture along the length of the string and its window opening can be adjusted, to suit the convenience of the archer. In general, however, a window distance of approximately 1 – 2 inches will be satisfactory under most conditions and the aperture will be slightly above the usual position of the nocking point. The use of grooves to retain the individual strands permits the nubs to be varied at will without loss of the nubs. The tension on the string will further cause the strands to secure the nubs in their adjusted place during use and they will not come loose, nor will they shift more than fractionally after each shot. Thus, the archer will be able to reload and shoot many arrows successively without the need to readjust the sighting aperture. In poor light the aperture window can be widened by raising the upper nub allowing a larger area to see through.

The nubs may be made from metal or aluminum, although plastic seems most preferable for its light weight, and economy of manufacture and cost. Instead of flat disk members, the nubs may be formed from small balls, or similar shapes. The balls may be slightly resilient, or rubbery so that the stressed string would indent into its surface and hold the nub during use.

The present invention thus provides a simple see-through sight, providing a variable length window directly through the string. The see-through aperture can be adjusted to conform to the angle of the string at full or partial draw and provides a window of sufficient length to enable the archer to see through it at any angle. The present invention is particularly advantageous for people who wear glasses, or false teeth, since the sight may be brought closer to the eyes than would otherwise be possible. The false teeth may be removed.

The nubs, whether flat disks or spherical members are symmetrical, and the strands of the strings are symmetrically arranged, so that the aperture 14 takes on a cylindrical form, between the nubs and a conical tapering form between each nub and string itself. Thus the stress on each strand is equalized, and uniformly distributed about the axis of the string, thereby insuring proper tension on the string and direction of flight for the arrow.

The string of the present invention may be used without any other sighting or aiming aid. It may however, be augmented by the more conventional aiming aids mounted directly on the bow link if desired. A third, or intermediate nub may be used, specifically on which to sight. This third nub may have a peep hole or other aim aid and may be adjusted to the exact eye level of the archer.

Turning to FIGS. 4 through 7 the release mechanism of the present invention comprises a L-shaped body generally depicted by the numeral 20, having the overall shape of a "pistol grip". The body is formed with a handle 22 adapted to be grasped by at least three fingers and a horizontal receiving portion 24 in which a finger hole 26 is drilled in order to receive a fourth finger. The finger hole 26 is for convenience only, and enables a firm grasp to be made on the grip; however, it is not absolutely essential and may be eliminated.

Figure 7:
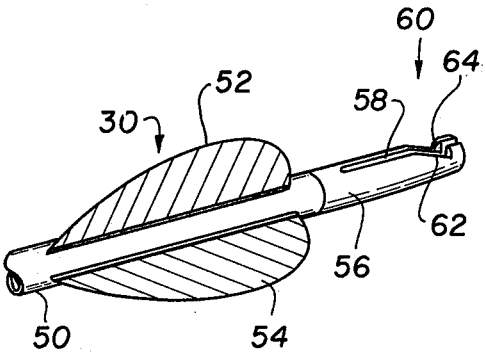
FIG. 7 is a perspective view of the nock end of an arrow.
Figure 4:
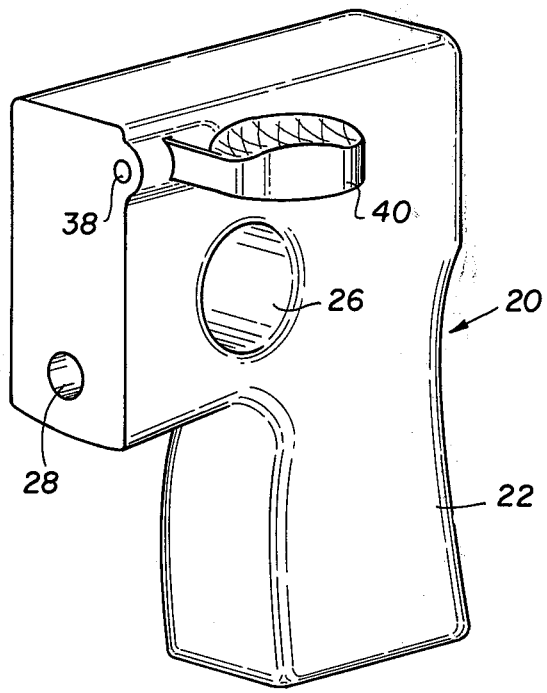
FIG. 4 is a perspective view of the release mechanism of the present invention.

Extending longitudinally through the receiving portion 24 is a small barrel bore 28, of sufficient diameter to receive therein the nock end of an arrow generally seen by numeral 30 in FIG. 7. The barrel 28 extends rearward into the grip about 1 - 1½ inches so as to be sufficiently long to receive a substantial portion of the nock, thereby stabilizing the arrow in the grip.

Mounted, in a vertical bore 32 above the barrel 28, between the finger hole 26 and the face of the receiving portion 22 is a freely movable latch bar 34. At its upper end, the latch bar 34 is pivotally connected with an arm 36, pivoted about a pin 38 extending along a pivot axis parallel to the barrel 28. The arm 36 extends outwardly of the side of the grip and has formed on it a thumb trigger 40. Preferably the arm 36, is connected to the latch bar 34, by providing the upper end of the latch bar with a rectangular cut out slot 42 into which the arm 36 freely extends. This allows the arm 36 to lift and lower the bar 34 in simple manner, and avoids the necessity of pins or links securing the two members together.

A flat leaf spring 44 is secured within the grip in a horizontal plane just above the upper end of the latch bar 34 and so as to resiliently engage the latch bar and normally biasing it downwardly into the barrel 28. The leaf spring may be replaced with a compression spring or similar biasing means, or the biasing means can be made to act on the arm 36, for example rather than on the latch bar 34.

The lower end of the latch bar 34 is provided with a slan ted face 46, extending from its front edge to its rear edge, providing a pointed end 48. Preferably the end 48 is slightly rounded.

As seen in FIG. 7 an otherwise conventional arrow 30 comprising a shaft 50 (the tip of which is not shown) having cock and hen feathers 52 and 54 respectively located at its rearward end. Secured to the end of the shaft 50 is a nock 56 which is somewhat longer than conventional. The nock is provided with a slot 58 which is also somewhat longer than usual, and a notch 60 conforming generally in shape to that of the end of the latch bar. That is, the notch 60, has a slant forward surface 62, and a straight back edge 64 normal to the axis of the shaft. The rearmost end of the nock 66 is somewhat tapered.

In operation, the arrow is placed on the string, such as seen in FIG. 1, by inserting the string into the slot 58, and the nock itself inserted in its barrel 28 of the grip. The tapered end 68, acting against the bias of the spring 44 to move the latch bar 34. The length of the barrel 28 is somewhat longer than the nock so that the notch 60 is insured of being properly moved past the latch bar before the force of spring 44 causes the end 48 to engage within the notch 60 and firmly seat therein. The length of slot 58, in the nock insures that the string does not enter into the barrel, thus avoiding its being crimped or wedged in the barrel and leaving it free to be pulled. The string thus remains free between the bight of the slot and the front face of the grip. When the string is pulled, the force component on the arrow created by the stressed string tends to pull the nock axially outward, causing the vertical face 64 of the notch to engage the rear edge of the latch bar 34, which together with the downward bias of the latch bar 34 securely locks the two together. The harder the string is pulled, the more force is created locking the latch. Consequently, with the present release mechanism, it is absolutely unnecessary to hold either arrow or string during the pulling process. This leaves the entire hand free to hold the grip and operate the release mechanism. The arrow remains stable in this position, since the stressed string and the engaging latch bar and notch prevent the arrow from rotating about its own axis.

The arrow is simply released by pressing down on the thumb trigger 40 which raises the latch bar 34 freeing the arrow. The stressed string immediately causes the arrow to fly from the grip. During this release, the archer is more able to hold the arrow steady since he does not need to concern himself with holding the arrow or string under stress.

An advantage of the release mechanism over the conventional mechanism is that the present device is held freely in the hand by all the fingers, it is not strapped to the hand or to any finger, and it may be discarded and/or laid away at any time. When using the present release mechanism, it is not necessary to provide the string with a nocking point or knot to locate the arrow. Thus, the string may be made simpler, and the present release mechanism can be employed on any size or type bow. The present mechanism in no way effects the normal draw of the bow.

An important advantage of the present release mechanism is that it holds the string on both sides of the nock, that is at the bight and at the front face of the grip. As a result it has been found that arrows shoot straighter and longer, than ordinarily nocked arrows.

Returning to FIG. 7, the nock 56 may be made of wood, or metal of the conventional type or even plastic and it may be attached in conventional manner by force fit, crimping or even by threading. Preferably, the slot of the nock should be aligned with the cock feather for greater accuracy.

From the foregoing it will be seen that the present invention provides improvement in both the sight of an arrow and its release from the string. The various objects and advantages enumerated earlier have all been met. Other advantages will be apparent to those skilled in the art.

Many modifications, changes and embodiments have been suggested, others will be obvious to those skilled in this art. Accordingly, the present disclosure is to be taken as illustrative only of the present invention and not limiting of its scope.

What is claimed:

1. In the process of sighting an archery bow string for a plurality of different users, said string comprising a plurality of elongated symmetrically twisted separable strands retained only at its ends the process comprising the steps of providing nubs formed in the shapes of a circular disks and each disk having a plurality of axially extending grooves uniformly spaced about the periphery of said grooves, inserting individual strands of the string within each of said grooves of each disk to separate said strands providing a see-through opening the width and depth of each of said grooves, a first user manually moving the disks along the length of the strand so as to provide a sight suitable for his particular requirements, and a subsequent user manually adjusting the disks along the length of the strand so as to provide a sight opening suitable for his particular requirements.

* * * * *